United States Patent [19]

Babichev et al.

[11] Patent Number: 4,906,048

[45] Date of Patent: Mar. 6, 1990

[54] METHOD OF DOWNHOLE HYDRAULICKING OF MINERAL RESOURCES

[76] Inventors: Nikolai I. Babichev, Bogorodsky val,6, korpus 2, kv. 432; Viktor A. Dmitriev, Moskvorechie, 35, Korpus 3, kv. 29; Grigory J. Abramov, ulitsa Udaltsova, I4, kv. 44; Vladimir F. Paveliev, ulitsa Volgina, 8, kv. 4IO, all of, Moscow, U.S.S.R.

[21] Appl. No.: 312,077

[22] Filed: Feb. 16, 1989

[30] Foreign Application Priority Data

Feb. 17, 1988 [SU] U.S.S.R. ..... 4380095

[51] Int. Cl.[4] ..... F21C 45/00

[52] U.S. Cl. ..... 299/17; 299/18

[58] Field of Search ..... 299/4, 5, 6, 16, 17, 299/18; 166/271; 179/67

[56] References Cited

U.S. PATENT DOCUMENTS 3,880,470 4/1975 Davis ..... 299/18 X
3,951,457 4/1976 Redford ..... 299/5
4,092,045 5/1978 Sullivan ..... 299/17

FOREIGN PATENT DOCUMENTS 1352061 11/1987 U.S.S.R. ..... 299/17
1362830 12/1987 U.S.S.R. ..... 299/17

*Primary Examiner*—Stephen J. Novosad
*Assistant Examiner*—David J. Bagnell
*Attorney, Agent, or Firm*—Lilling & Greenspan

[57] ABSTRACT

The method of downhole hydraulicking of mineral resources consists in sinking main holes, fitting the main holes with casings down to a depth below a lower boundary of a pay-out bed, installing an apparatus for hydraulicking mineral resources in each main hole, breaking rock and forming cavities in a bedrock by a jet from a monitor provided in the apparatus for hydraulicking mineral resources. Auxiliary holes are sunk each above a face of each cavity, using a drilling tool, down to the cavity so that the mineral enters the cavity from the auxiliary hole as soon as the drilling tool is withdrawn therefrom. Pulp is lifted to the surface through the main holes until overburden rock is identified in the pulp.

4 Claims, 1 Drawing Sheet

METHOD OF DOWNHOLE HYDRAULICKING OF MINERAL RESOURCES

FIELD OF THE INVENTION

The present invention relates to mining and has specific reference to methods of downhole hydraulicking of mineral resources.

The present invention may be of utility in the hydraulic mining of solid mineral resources and building materials such as clay, sand, phosphate rock, peat, oxide-bearing iron and manganese ores, bauxites.

It may find application in off-shore mining projects, those confined to the continental shelf in particular, in erecting underground facilities for the storage of gases and liquids and disposing of industrial waste, in driving collectors which, on being filled with concrete, can be used as strip foundations.

BACKGROUND OF THE INVENTION

Widely known in the art is a method of downhole hydraulicking of mineral resources (U.S. Pat. No. 3,951,457) according whereto development holes are sunk from the surface down to a pay-out bed and casings are installed in the holes so that the casing shoes are at least 4–6 m above the face of each hole. An apparatus for hydraulicking mineral resources, consisting of a monitor located at the lower end of the apparatus and a pulp-lifting mans (commonly a jet pump) at the end face of the apparatus, is lowered into the casing so that the monitor is below the casing shoe. A liquid, pressure-fed into the hole, turns into a high-pressure jet on passing through the monitor and breaks the rock. The pulp which forms is lifted to the surface. In operation, the apparatus travels upwards and forms cavities the floors where slope downward toward the hole so that the pulp can flow to the jet pump.

The prior art method of downhole hydraulicking of mineral resources is ineffective in working water-bearing beds and those containing drift sand. In incompetent beds, the water jet has a short range and the yield of mineral from the cavities is low. As the mineral is being broken and removed from the face, a continuous caving in takes place in this case. The caving in spreads to the overlaying strata and reached the dead rock of the overburden with the result that this rock is lifted to the surface. Sagging of the ground surface is a hazard which is very likely to occur in practicing the prior art method of downhole hydraulicking of mineral resources when shallow pay-out beds are being worked or the overburden is an incompetent one. This creates a professional hazard and endangers the safety of the hydraulic mining equipment.

SUMMARY OF THE INVENTION

It is an object of the invention to enhance the effect of hydraulicking mineral resources from water-bearing pay-out beds displaying a drift-sand behaviour.

The essence of the invention is that in a method of downhole hydraulicking mineral resources, involving the sinking of main holes, fitting casings into the main holes, introducing an apparatus for hydraulicking mineral resources, incorporating a monitor and a means of lifting pulp to the surface, into each main hole, feeding liquid into the main holes, breaking rock and forming cavities by a liquid jet from the monitor of the apparatus for hydraulicking mineral resources, lifting pulp to the surface through the main holes until the rock constituting an overburden is identified in the pulp, according to the invention the main holes are sunk and provided with the casing down to a depth below a lower boundary of a pay-out bed and the cavities formed by the jet from the monitor of the apparatus for hydraulicking mineral resources in breaking the rock in each main hole are located in a bedrock, whereby, after the cavities have been formed in the bedrock, auxiliary holes are sunk above faces of the cavities with the aid of a drilling tool so as to become connected to the cavities with the result that the mineral enters the corresponding cavity from the pay-out bed as soon as the drilling tool is withdrawn from the corresponding auxiliary hole.

It is expedient to install means of hole reaming in the auxiliary holes and to ream these holes through a distance between the connection of each auxiliary hole with the corresponding cavity and the rock of the pay-out bed in order to enhance the effect of hydraulicking mineral resources.

It is also expedient to form cavities from each main hole in a direction opposite to that sunk in which are the subsequent main holes in order to ensure safety for the personnel and the ground equipment for hydraulicking mineral resources.

The present invention contemplates the location of the cavities in the bedrock and an extension of the range of breaking the rock, therefore its implementation creates the prospect of enhancing the effect of hydraulicking mineral resources from water-breaking bed with drift-sand behaviour which offer low gain of worked by conventional mining and open-cast methods.

BRIEF DESCRIPTION OF THE DRAWINGS

The present invention will be best understood from the following detailed description of a preferred embodiment of the method of downhole hydraulicking mineral resources and the drawings wherein.

DESCRIPTION OF THE PREFERRED EMBODIMENT

The method of downhole hydraulicking of mineral resources consists in the following.

Figure 1:
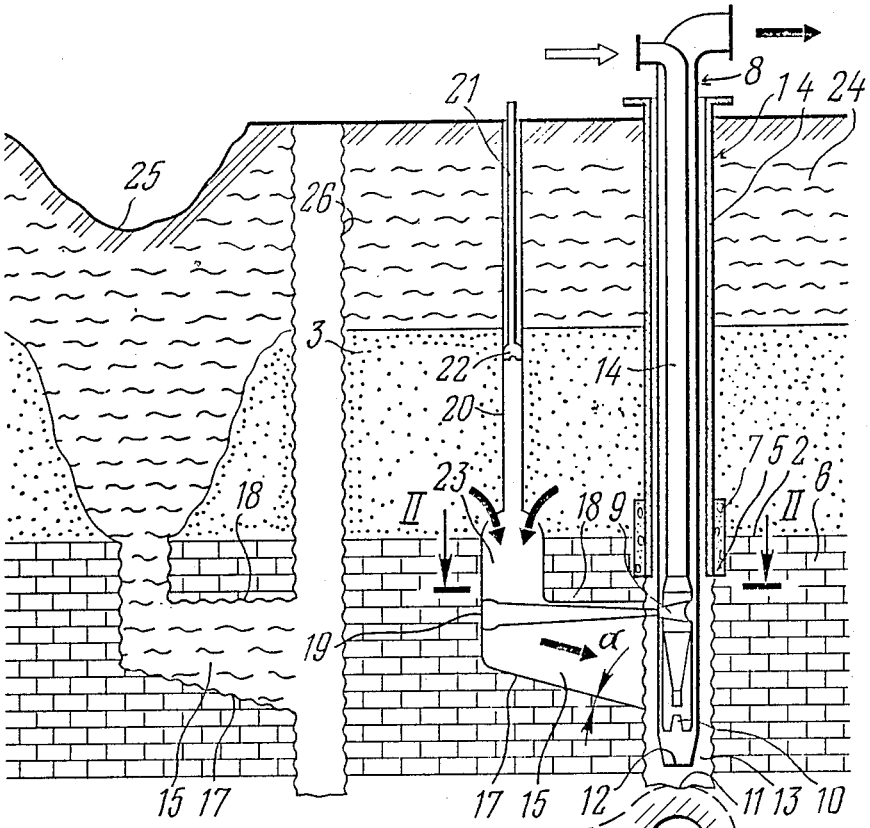
FIG. 1 is a general view of a facility for working a pay-out bed in accordance with the invention, shown in cross-section.

Referring to FIG. 1, main holes 1 are sunk from the surface of the earth (or, alternatively, from an off-shore rig or a mine working) to a depth below a lower boundary 2 of the pay-out bed 3. A metal casing 4 is installed in each main hole 1 so that a lower end face 5 of the casing 4 is below the lower boundary 2 of the pay-out bed 3. An annular space formed between the lower end face 5 of the casing 4 and the rock of the pay-out bed 3 is filled with concrete which, on being set, serves as a hydraulic seal 7 of the main hole 1 at the interface between the pay-out bed 3 and a bedrock 6. A concrete plug formed in the main hole 1 is drilled out. An apparatus 8 for hydraulicking mineral resources, incorporating a monitor 9 and a means of lifting pulp to the surface in the form of a jet pump 10, is installed in each main hole 1 so that the monitor 9 is located at a depth below the lower end face 5 of the casing 4.

The distance between the lower boundary 2 of the pay-out bed 3 and a face 11 of each main hole 1 is decided by the distance between the lower boundary 2 of the pay-out bed 3 and the lower end face 5 of the casing 4, which is 1–1.5 m, the length of the apparatus 8 between the monitor 9 and a lower end face 12 of the apparatus 8, which is 2–3 m, and the depth of a sump 13 of the main hole 1 accumulated wherein is pulp, which is 1–2 m. Adding up, the distance between the lower boundary 2 of the pay-out bed 3 and the face 11 of each main hole 1 is roughly 4–6 m.

A liquid, which can be industrial water containing sediments and chemical admixtures, is pressure fed into the main holes 1, reaching the monitor 9 of each apparatus 8. A high-pressure jet issuing from the monitor 9 breaks the bedrock 6 to form a crater which is then transformed into a cavity 15 as the monitor 9 of the apparatus 8 is smoothly displaced along an axis 14 of the main hole 1. Next, the monitor 9 of the apparatus 8 is returned to the initial depth, turned towards the location of a next cavity 15 and set to operate so as to form this cavity. Continuing in this way, all the vertical cavities 15 (FIG. 2) are formed within a cavity sector 16. The floor 17 (FIG. 1) of the cavities 15 makes an angle $\alpha$ of 5°–7° with the horizontal so that the pulp resulting from the breaking of the bedrock 6 can flow into the sump 13 of the main hole 1 due to gravity. An upper wall 18 of each cavity 15 is located close to the lower boundary 2 of the pay-out bed 3, i.e. roughly at 1–1.5 m, provided the monitor 9 is set horizontally. Since the monitor 9 of the apparatus 8 works at a depth which is below the lower boundary 2 of the pay-out bed 3, is operating range is at its maximum (11–13 m) which is used to form cavities 15 in the bedrock 6 without providing the cavities 15 with a connection to the pay-out bed 3. The cavities 15 are thus formed from the main holes 1 in a dewatered rock so that the high-pressure monitors 9 of the apparatus 8 operate at their maximum effective range and the rate of breaking the bedrock 6 is at its maximum as well.

The axis of the monitor 9 of each apparatus 8 and the high-pressure jet issuing from the monitor 9 are directed at right angles to the axis 14 of the main hole 1. In sand and clay, the sloping floor 17 of the cavities 15 is formed due to an erroding effect of the pulp flowing from the face 19 of the cavity 15 to the sump 13 of the main hole 1. In competent rock, the sloping floors 17 of the cavities 15 are formed with the aid of the high-pressure jet of the monitor 9 the axis whereof makes a small angle with the axis 14 of the apparatus 8 for hydraulicking mineral resources.

Auxiliary holes 20 are sunk successively down to the cavities 15 so as to become connected thereto, using a drilling tool 21 with a bit 22. They are located above the faces 19 of the cavities 15 at a distance from the main hole which equals the maximum range broken whereat is the bedrock 6. On withdrawing the bit 22 from each auxiliary hole 20, the mineral is discharged into the corresponding cavity 15.

Each auxiliary hole 20 some 180–250 m in diameter clears the way, on being connected to the corresponding cavity 15, for the mineral of the pay-out bed 3 to proceed to the main hole 1 via the cavity 15, provided the drilling tool 21 is removed from the auxiliary hole 20. Ater that the drilling rig is dismantled and the personnel is sent away from the mouth of the auxiliary hole 20.

Means of hole-reaming are lowered into the auxiliary holes 20 to ream them through distances between their conections to the cavities 15 and the rock of the pay-out bed 3. The reaming operations produces chambers 23 with a diameter which is 3–5 times that of the auxiliary holes 20.

Suitable for use as the hole-reaming means are mechanical reamers, monitors and explosives. The rock extracted from the pay-out bed 3 falls into the sump 13 of the main hole from the cavity 15, where the inlet into the jet pump 10 of the apparatus 8 is located, and is lifted to the surface by the apparatus 8.

The lifting of the pulp to the surface over the main hole 1 goes on until the rock of the overburden 24 is identified in the pulp. The apparatus 8 is withdrawn then from this hole and fitted into the next one.

Figure 2:
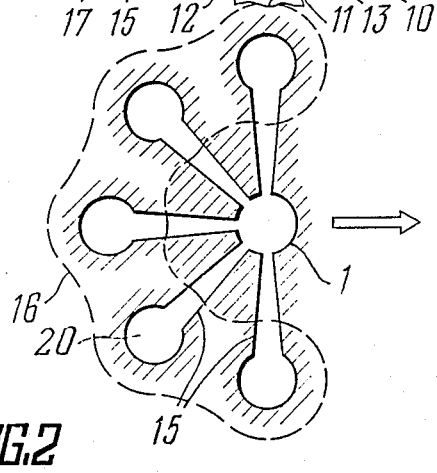
FIG. 2 is a section on line II—II of FIG. 1 according to the invention.

Referring to FIG. 2, the cavities 15 are formed from each main hole 1 and the auxiliary holes 20 are started towards the faces 19 of the cavities 15 in a direction opposite to that sunk in which are the subsequent main holes 1. The arc of the sector 16 formed wherein are the cavities 15 from each main hole 1 is decided by the geological features of the bedrock 6 and the drift-sand behaviour of the pay-out bed 3. The arc of the sector 16 should not exceed 180°.

On extracting all the mineral, the overburden 24 (FIG. 1) may sag so that a trough 25 is formed above the auxiliary holes 20 but this is located at a distance from the mouth of the depleted main hole 26 so that no danger exists for the equipment and personnel.

The downhole hydraulicking of mineral resources enhances the effect of hydraulic mining and ensures safety for the ground equipment and personnel.

What is claimed is:

1. A method of downhole hydraulicking of mineral resources consisting in sinking main holes to a depth below a lower boundary of a pay-out bed;

fitting casings into said main holes to a depth below the lower boundary of the pay-out bed;

placing in each said main hole an apparatus for hydraulicking mineral resources which incorporates a monitor and a means of lifting pulp to the surface;

feeding liquid into said main holes;

breaking bedrock in each said main hole;

forming cavities in the bedrock with the aid of a high-pressure jet from said monitor of said means of hydraulicking mineral resources;

sinking auxiliary holes, with the aid of drilling tools, so that each auxiliary hole is located above a face of said cavities and becomes connected to this cavity, whereby the mineral is admitted from the auxiliary holes into the cavities as soon as the drilling tools are withdrawn from the auxiliary holes.

2. A method as claimed in claim 1, wherein means of reaming auxiliary holes are lowered into said auxiliary holes;

said auxiliary holes are being reamed through a distance between a connection of said auxiliary hole to said corresponding cavity and the rock of the pay-out bed.

3. A method as claimed in Claim 1, wherein said cavities are being formed from each said main hole in a direction opposite to that in which subsequent main holes will be located.

4. A method as claimed in claim 2, wherein said cavities are being formed from each said main hole in a direction opposite to that in which subsequent main holes will be located.

* * * * *